United States Patent [19]

Wallo

[11] Patent Number: 4,804,161

[45] Date of Patent: Feb. 14, 1989

[54] HANGING DEVICE FOR PICTURE FRAMES OR LIKE OBJECTS, AND METHOD

[75] Inventor: William H. Wallo, Clearwater, Fla.

[73] Assignee: W. H. Wallo & Associates, Inc., Clearwater, Fla.

[21] Appl. No.: 654,536

[22] Filed: Sep. 26, 1984

Related U.S. Application Data

[63] Continuation-in-part of Ser. No. 522,018, Aug. 11, 1983, abandoned.

[51] Int. Cl.[4] ..... A47G 1/02

[52] U.S. Cl. ..... 248/544; 248/489; 40/152.1

[58] Field of Search ..... 248/476, 489, 495, 544; 40/152.1

[56] References Cited

U.S. PATENT DOCUMENTS

| | | | |
|---|---|---|---|
| 1,034,886 | 8/1912 | Dehn | 248/489 |
| 1,297,584 | 4/1919 | Mock | 248/489 |
| 1,314,548 | 9/1919 | Taylor | 248/489 |
| 1,794,327 | 2/1931 | Simon | 248/495 |
| 2,448,137 | 8/1948 | Cody | 248/497 |
| 2,488,925 | 11/1949 | Miller | 248/495 |
| 2,629,193 | 2/1953 | Hughes | 248/476 |
| 2,681,194 | 6/1954 | Halvorsen | 248/29 |
| 2,867,855 | 1/1959 | Xanten | 248/291 |
| 3,128,979 | 4/1964 | Damelio | 248/300 |
| 3,138,359 | 6/1964 | Stewart | 248/31 |
| 3,265,339 | 8/1966 | Hushek | 248/29 |
| 3,330,525 | 7/1967 | Weinstein | 248/496 |
| 3,552,708 | 1/1971 | Hillstrom | 40/152.1 |
| 3,730,469 | 5/1973 | Shields | 248/258 |
| 3,946,512 | 3/1976 | Shapiro | 40/152.1 |
| 4,085,917 | 4/1978 | Brantley, Jr. | 248/489 |
| 4,162,056 | 7/1979 | Moorhead | 248/495 |
| 4,171,117 | 10/1979 | Prochaska | 248/495 |
| 4,385,744 | 5/1983 | Sherman | 40/152.1 |
| 4,420,138 | 12/1983 | Sobel | 40/152.1 |

FOREIGN PATENT DOCUMENTS

| | | | |
|---|---|---|---|
| 65795 | 10/1947 | Denmark | 248/224.2 |
| 2266041 | 10/1975 | France | 248/489 |
| 2276019 | 1/1976 | France | 248/224.1 |
| 2324263 | 4/1977 | France | 248/495 |
| 74311 | 9/1917 | Switzerland . | |
| 122329 | 1/1919 | United Kingdom | 248/224.1 |
| 1447422 | 8/1976 | United Kingdom | 248/223.4 |

*Primary Examiner*—J. Franklin Foss
*Assistant Examiner*—Robert A. Olson
*Attorney, Agent, or Firm*—Hill, Van Santen, Steadman & Simpson

[57] ABSTRACT

A hanging device and method for picture frames or like objects wherein the device comprises a pair of spaced horizontally positionable prongs which are adapted to be secured in accurate horizontal alignment on a vertical supporting surface such as a wall. The prongs extend upwardly and outwardly from the wall and have upwardly extending points and may have downwardly and rearwardly extending cam surfaces so that a variety of different types of frame top moldings or other hanging devices are adapted to be efficiently engaged for supporting the hanging objects in a stable, non-skewing hanging position. By having the tips of the prongs project upwardly above the structure such as a bar by which the prongs are mounted, the object as hung is adapted to be engaged flat against a wall surface. The device is especially well adapted for supporting extruded aluminum picture frames.

23 Claims, 2 Drawing Sheets

FIG.1
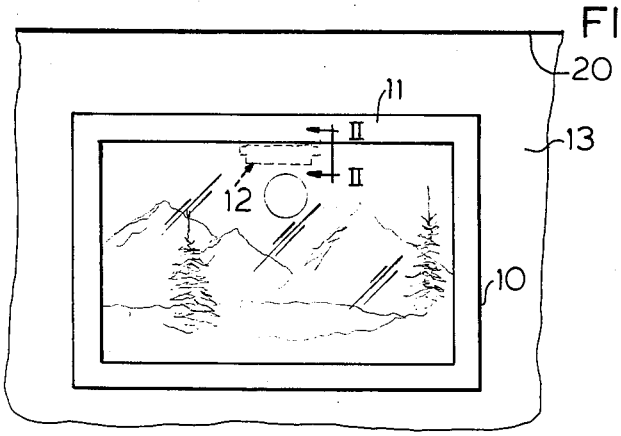
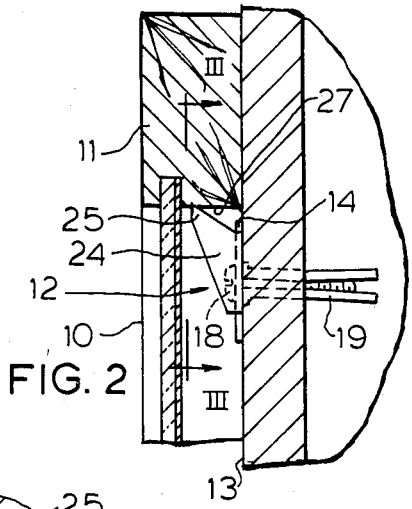
FIG. 2
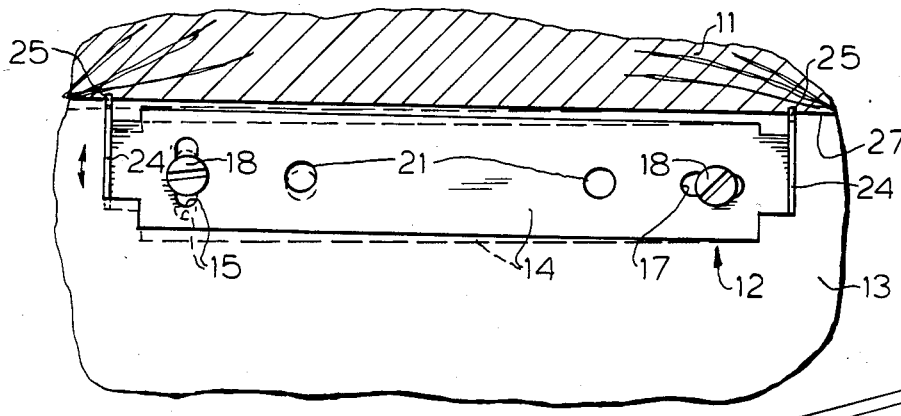
FIG. 3
FIG.4
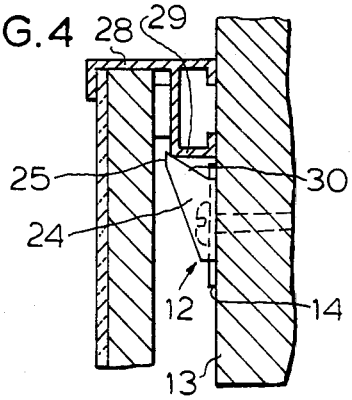
FIG. 5
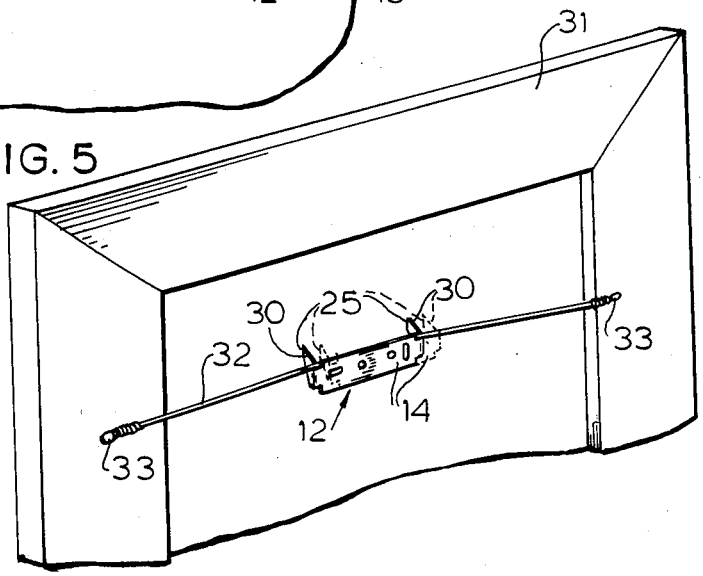
FIG.7
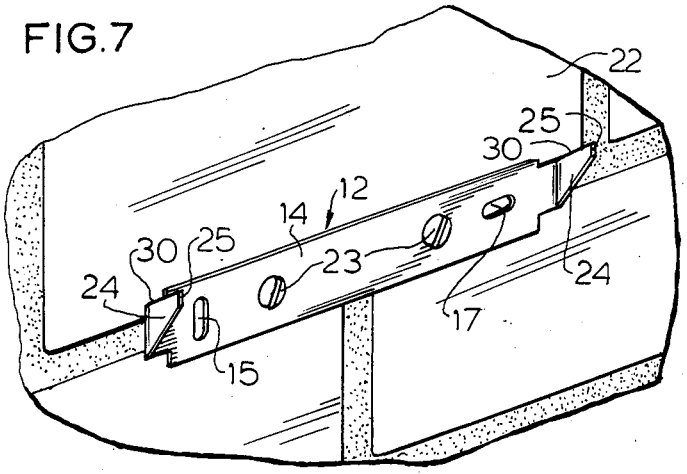
FIG.6
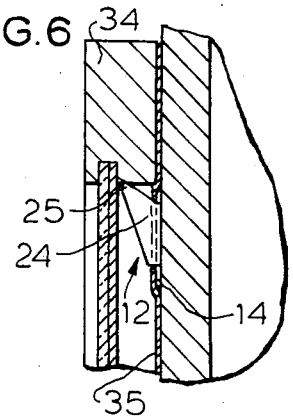

HANGING DEVICE FOR PICTURE FRAMES OR LIKE OBJECTS, AND METHOD

This application is a continuation-in-part of application Ser. No. 06/522,018 filed 08/11/83, now abandoned.

This invention relates to a hanging device or bracket for picture frames or like objects and method, and is more particularly concerned with a new and improved device which is especially adapted for supporting virtually any type of such a frame, or other object equipped to be hung like a picture frame, efficiently and free from skewing, and a method of mounting the same.

As heretofore practiced, hanging of picture frames or like objects has generally involved securing individual hooks, or one or more nails, to a wall and attaching picture wire to the back of the object for engaging the nail or hook; or a metal eye or hanger bar device may have been attached to the object for engagement on the hook or nail. Where the object is hung on a nail or hook, skewing is an ever present problem, especially in the presence of wall vibrations. This is especially prevalent and noticable in grouped picture hangings. In addition, in such grouped hangings it is often difficult to attain proper symmetry, especially where the tops of the frames are to be in horizontal alignment, or must be in a particular spaced relation to one another.

When employing the prior hanging devices, it has been common for the hung objects to tend to cant outwardly at their top edges. In other words, it is extremely difficult, if not impossible, to attain flush engagement of the backs of the objects with the supporting wall or other vertical surface.

It is therefore an important aim of the present invention to provide a new and improved hanging device for picture frames or like objects, and method which will overcome the disadvantages, drawbacks, inefficiencies, limitations, shortcomings and problems inherent in prior means and methods for hanging such objects.

Another aim of the invention is to provide a new and improved hanging device of the character described which is of simple and economical construction and is easy to install.

A further aim of the invention is to provide a new and improved frame or like object hanging device and method which will assure stable hanging of the object and will permit horizontal shifting of the object without disturbing the hanging stability.

Still another aim of the invention is to provide a new and improved hanging device and method providing for ease of attaining and maintaining horizontal stability of the hung object.

Yet another aim of the invention is to provide a new and improved hanging device and method adapted for hanging a wide variety of different types of frames or like objects.

To the attainment of the foregoing and other aims of the present invention there is provided a device for hanging picture frames or like objects, comprising elongate horizontally positionable base bar means having front and back faces and means for attaching the bar means to a vertical supporting surface such as a wall and with said back face directed toward said surface, and supporting structure extending from the front face of the bar means and providing upwardly projecting means adapted to engage a downwardly facing surface on the top molding of a frame, or other hanging means on a picture or other object to be hung, for thereby supporting the same in a stable nonskewing hanging position.

This invention also provides a hanging device for picture frames or like objects, comprising a pair of horizontally spaced and aligned upwardly projecting relatively sharp prongs arranged to project outwardly and upwardly relative to a vertical supporting surface, and means for attaching the prongs to the supporting surface, and the tips of the prongs extending substantially above the attaching means, so that a downwardly facing surface on the upper portion of a picture frame or like object is adapted to be engaged by the prongs for hanging of the object on the supporting surface, with the back of the object flat against the supporting surface, if desired.

There is also provided by the present invention a method of hanging a picture frame or like object having a downwardly facing upper portion surface, comprising mounting a pair of outwardly and upwardly projecting relatively sharp tipped prongs on a vertical supporting surface, and with the tips of the prongs extending substantially above means for securing the prongs to the supporting surface, adjusting the prongs to be in a straight horizontal alignment, and engaging the downwardly facing surface on the prongs.

Other aims, features and advantages of the present invention will be readily apparent from the following description of preferred embodiments thereof, taken in conjunction with the accompanying drawing, although variations and modifications may be effected without departing from the spirit and scope of the novel concepts of the disclosure, and in which:

FIG. 1 is an elevational view of a picture frame hung by means of a frame hanging device according to the present invention;

FIG. 2 is an enlarged fragmentary sectional detail view taken substantially along the line II—II of FIG. 1;

FIG. 3 is a vertical sectional elevational detail view taken substantially along the line III—III of FIG. 2;

FIG. 4 is a view similar to FIG. 2 but showing the hanging of a different form of frame;

FIG.5 is a rear elevational view of a frame showing how it is adapted to be hung with a device of the present invention but utilizing a picture wire on the frame;

FIG. 6 is a view similar to FIGS. 2 and 4 but showing the hanging device employed in connection with another style of frame;

FIG. 7 is a perspective view showing an alternate mode of attaching the frame hanging device of the present invention.

Figure 8:
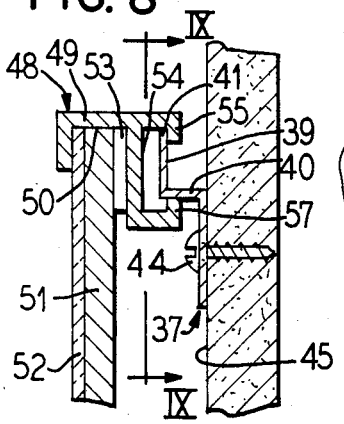
FIG. 8 is a vertical sectional detail view similar to FIG. 4, but showing a modification.

On reference to FIGS. 1, 2 and 3, a picture frame 10 is hung by its top molding 11 on a frame hanging bracket device 12 which is adapted to be fixedly secured to a vertical supporting surface 13 such as a wall.

In a simple, economical construction, the device 12 comprises an elongate flat base plate means in the form of a horizontally positionable base bar 14 having front and back faces and means for attaching the bar to the supporting surface 13 with the back face directed toward such surface. In a preferred construction, the device 12 comprises a sheet metal stamping, and the means for attaching comprise a fastener receiving hole 15 in one end portion of the base bar 14 and a fastener receiving hole 17 in the opposite end portion of the bar. Respective fasteners such as nails or screws 18 are adapted to be projected through the holes 15 and 17 and secured into the supporting surface 13. Where the supporting surface 13 is drywall, or the like, screw anchors 19 may be used.

By having the fastener holes 15 and 17 elongated as best seen in FIG. 3, criticality of placement of the fasteners 18 is minimized. For example, by having the hole 15 vertically elongated, vertical fine adjustment of the bar 14 is adapted to be made from the dash position shown to the full line properly adjusted horizontal position by tilting the bar 14 about the fulcrum provided by the fastener 18 in the hole 17. By having the hole 17 horizontally elongated tolerance allowance is provided for a reasonable range of spacing of the fasteners 18. Through this arrangement the places on the surface 13 at which the fasteners 18 are to be set may be quickly ascertained by using the fastener holes 15 and 17 as gauges for marking where the fastener holes are to be made in the surface 13, the fastener holes drilled or punched, and then the bar 14 placed into position and the fasteners driven with final tightening effected after precise horizontal orientation of the bar 14. Such orientation is easily gauged by sighting one horizontal edge of the bar 14 with respect to a horizontal reference line such as where the wall surface 13 merges with a ceiling surface 20 (FIG. 1). On the other hand, if preferred, a level may be applied across the top of the device 12 for attaining perfect accuracy in horizontal disposition of the bar 14. Also, the bar 14 may be secured in place and the frame hung on the device 12, but if the frame appears to hang askew it can be removed and adjustment of the bar effected.

The base bar 14 may have a pair of spaced stamping die pilot holes 21 which may also be used as additional mounting holes if desired. For example, where the device 12 is to be mounted on a masonry wall 22 (FIG. 7) the holes 21 may act as a drilling jig when the device 12 has been properly placed to receive a masonry drill for drilling socket holes to receive fastening screws 23 for retaining the device 12 in position on the wall 22. On the other hand, if it is desired to anchor the vertically tiltable end of the base bar 14 after proper horizontal positioning has been attained as described in connection with FIG. 3, a fastener such as a nail or screw may be secured through the hole 21 nearest the vertical fastener hole 15. This might be particularly desirable where a heavy picture frame or the like is to be supported and unusual vibrations or other disruptive force may be present which might tend to cause the tiltable end of the base bar 14 to loosen and permit downward tilting under the weight of the frame.

For receiving and engaging the underside of the top molding 11 of the frame 10, the device 12 is provided with frame supporting structure comprising spaced, horizontally alignable prong means 24 desirably extending from the front face of the bar 14 on opposite end portions of the bar. Although the prongs 24 may be punched out of the body of the bar end portions, in a preferred form, the prongs 24 comprise a respective forwardly bent ear at each end of the bar 14. Each prong 24 is shaped to provide an upwardly projecting pointed tip or barb 25 which is adapted to engage a downwardly facing shoulder surface 27 of the top molding 11 of the frame 10. Through this arrangement, it is possible, as best visualized in FIG. 2, to have the entire frame 10 close to or flushly abutting, flat against the supporting surface 13 where the molding surface 27 is of sufficient width. If the molding 11 is wood or other material of similar soft texture, the barbs 25 may dig slightly into the surface 27 and thus provide very secure anchorage against possibly pulling of the frame 10 away from the surface 13.

By having the barbs 25 of the prongs 24 extending to a substantial extent above the top edge of the bar 14, it will be apparent as seen in FIG. 2, that this facilitates the hung frame 10 to abut flatwise against the supporting surface 13 free from any interference from the bar 14 and without tilting away from the surface 13 in any direction.

Aluminum frames 28 (FIG. 4) are especially well adapted to be hung by means of the frame hanging device 12 of the present invention. This type of frame is generally equipped with a molding structure which, particularly along the top of the frame, has a depending rib 29 along the back side of the frame. This rib 29 provides a shoulder surface which is adapted to be received on a downwardly and rearwardly slanting cam surface 30 on each prong element 24 and facing generally toward the surface 13. This arrangement, in effect, provides for a hooked-on engagement of the frame rib 29 with the device 12. By virtue of the cam surface 30, the rib 29 tends to slide downwardly and toward the supporting surface 13 whereby to bias the frame 28 to rest flush against the surface 13.

Where a frame 31 (FIG. 5) is equpped with a picture wire 32 for hanging the frame, the wire may be in a conventional loop form, but may more desirably be stretched fairly taut horizontally. Upon engagement of the taut wire 32 with the cam surfaces 30 of the prong elements 24, the wire will tend to gravitate downwardly and toward the wall supporting surface 13 and thereby bias the back of the frame 31 as closely as practicable toward a flush engagement with the wall surface, to the extent permitted by anchors 33 for the wire 32, or any other projection on the back of the frame. By virtue of the spaced points of support for the wire 32 provided by the spaced prong elements 24, a range of horizontal adjustment is permitted along the picture hanging wire 32, as graphically illustrated on comparison of the full line and dash line positions of the hanging device 12. This lateral tolerance is equally applicable to hanging of frames on the device 12, by means of their top molding. Yet the frame 31 will remain in a square horizontal position, in contrast to where a single central hanger is engaged by the picture wire and any off center positioning relative to the hanger will result in skewing of the frame 31.

In FIG. 6 is depicted an adaptation of the hanging device 12 for hanging a frame 34 provided with a paper backing 35. In this situation, the frame 34 is easily hung by puncturing of the backing 35 by means of the prong elements 24, and more particularly the sharp prong tips 25, and then the tips 25 engaged with the underside of the top molding of the frame 34, as shown.

Figure 9:
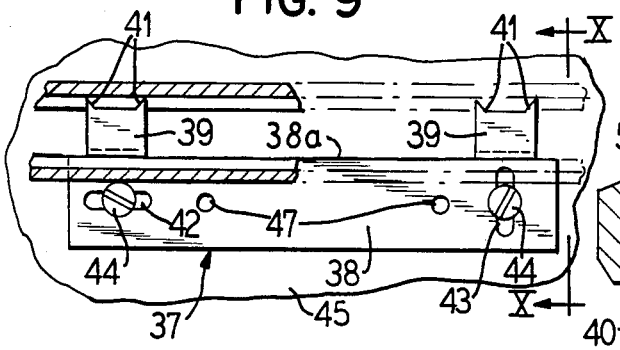
FIG. 9 is a vertical sectional detail view taken substantially along the line IX—IX in FIG. 8.

FIGS. 8 and 9 depict a frame-hanging bracket device 37 similar to the device 12, but having on its elongate horizontally positionable base bar 38, frame-supporting structure comprising spaced, horizontally alignable prong means 39 formed on and extending upwardly from the upper edge portion 38a of the bar 38. The prongs 39 are located at respectively opposite end portions of the body of the bar 38 which is desirably stamped from suitable sheet metal having substantial horizontal length and substantial vertical width and with the prongs 39 formed integrally with the top edge 38a of the bar. Desirably, the prongs 39 project upwardly in planes substantially parallel to the plane of the bar 38 and are attached to the bar in outwardly offset relation by means of respective offsetting flanges 40. On their upper ends, each of the prongs 39 may be provided with a pair of upwardly projecting pointed tips or barbs 41, which may be located at the opposite sides of the upper end of each of the prongs 39, and have an upwardly facing shoulder edge surface extending between them.

Similarly as described for the device 12, the body or base bar 38 has adjacdent to one end a horizontally elongated screw hole slot 42 and adjacent to the opposite end a vertically elongated screw hole slot 43. Thereby, the bar 38 is adapted to be accurately horizontally positioned and secured as by means of screws 44 to a vertical surface 45 which may be provided by the wall of a room, although the surface 45 may be on a display board, stand, or the like. The method of attaining accurate horizontal disposition of the bar 38 by means of the elongated holes 42 and 43 is the same as described in connection with the holes 17 and 15 of the device 12. Similarly as the device 12, the bar 38 of the device 37 may have auxiliary holes 47 as and for the same purpose as described in connection with the holes 21 of the device 12.

The device 37 is especially well suited for hanging a picture or other object equipped with an extruded aluminum frame 48. Frames of this type commonly have a frame body 49 provided with a picture receiving channel 50 wherein a picture panel 51 is adapted to be marginally received with a protective glass panel 52 in front and if necessary a filler or shim 53 at the back side of the margin of the picture panel. Along its back side the frame 48 is provided in its top molding structure with a rearwardly opening horizontal channel 54, within which the prongs 39 are adapted to be received for hanging the frame. Along its upper side the channel 54 provides shoulder means engageable for supporting the frame by the barbs 41. This shoulder means includes at the opening from the channel 54 a rear depending flange rib 55 behind the barbs 41 engage whereby to retain the frame 48 against displacement from the shoulder. Along the lower side of the channel 54 a rear upstanding flange rib 57 facing in spaced relation to the rib 55 may engage under the offsetting flanges 40 of the prongs 39 for cooperating with the prongs 39 in maintaining the frame 48 and thereby the picture in a vertical parallel orientation relative to the surface 45.

Figure 10:
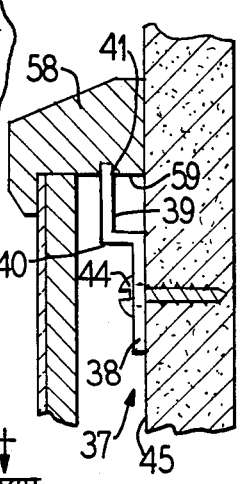
FIG. 10 is a vertical sectional detail view similar to FIG. 8 and as though taken along the vertical sectional line X—X in FIG. 9, and showing the hanging device supporting a different type of picture frame.
Figure 11:
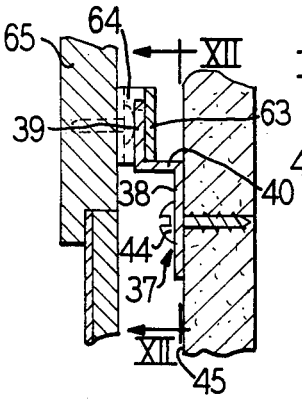
FIG. 11 is a view similar to FIGS. 8 and 10 but showing the frame equipped with a hanger clip.
Figure 12:
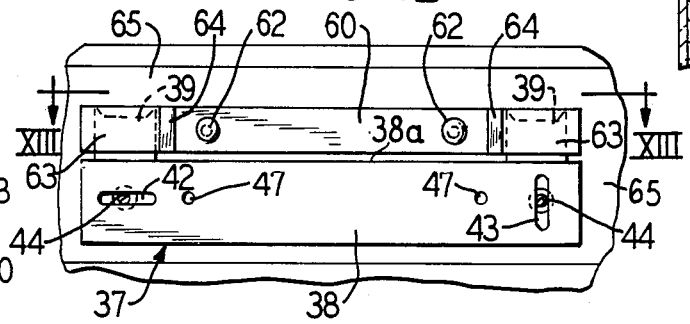
FIG. 12 is a sectional elevational view taken substantially along the line XII—XII in FIG. 11.
Figure 13:
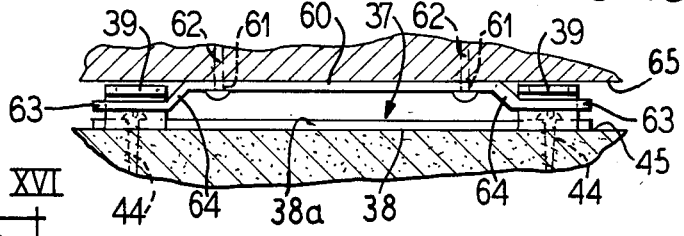
FIG. 13 is a sectional plan view taken substantially along the line XIII—XIII in FIG. 12.

In FIG. 10 the device 37 is depicted supporting a picture frame 58 through its top molding which has a downwardly facing shoulder surface 59 adapted to be engaged by the barbs 41 which may dig into the frame molding where such molding is penetrable by the barbs. It will be apparent that by virtue of the plurality of barbs 41 and which may be relatively short, a secure anchorage of the frame top molding is attained with high assurance against unintended displacement of the frame. In the arrangement depicted, the back of the frame is adapted to be supported flush against the surface 45, a feature which is attainable with special efficiency because the prongs 39 project substantially above the upper edge **38*a* of the bar 38** so that there is full freedom for the flush engagement of the frame with the supporting surface.

Another desirable arrangement is shown in FIGS. 11–14, especially suitable for frames or other objects which do not provide in and of themselves shoulder means engageable by the prongs 39. To this end, an elongated hanger clip 60 conveniently formed from sheet metal, has a body which is relatively narrower than the body bar 38 of the device 37 but desirably of about the same length. At spaced intervals, the elognate flat body of the clip 60 is provided with fastener holes 61 for receiving fasteners such as nails or screws 62 for attaching the clip to an object to be hung. At each opposite end the clip 60 has an outwardly offset, longitudinally extending wing flange or finger 63 offset from the associated end of the clip by an offsetting flange 64. Each of the fingers 63 is adapted to serve as shoulder means on the object to be hung and is received in nested relation with the generally hook-shape socket provided within the angle defined by the prong 39 and the offsetting flange 40 in each instance. Thereby, a frame 65 having no other shoulder means than the clip 60 attached thereto by means of the holes 61 and the fasteners 62 is adapted to be hung accurately and free from liability to cant or tilt. Paper backed picture frames in which it is desired to maintain the paper backing or cover inviolate can readily be hung by means of the clip 60 and the bracket device 37.

Figure 14:
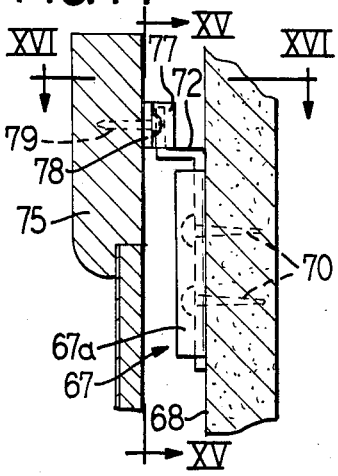
FIG. 14 is a sectional view similar to FIG. 8 but showing another modification.
Figure 15:
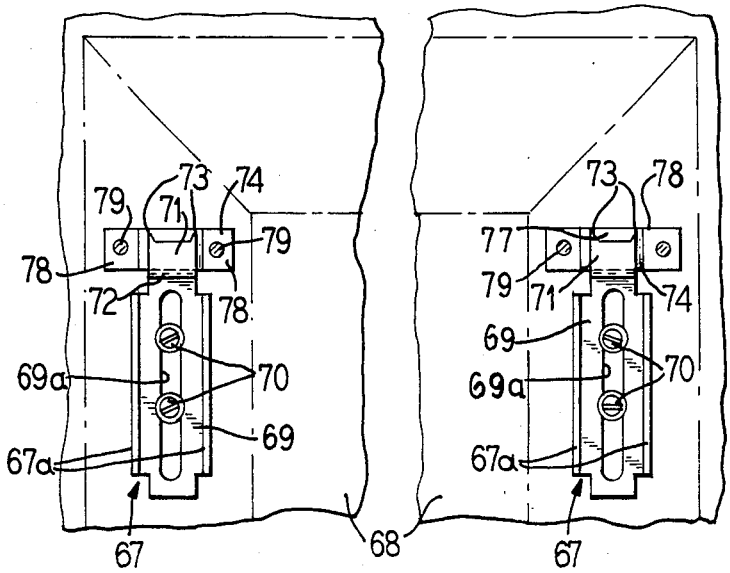
FIG. 15 is a fragmental sectional elevational view taken substantially along the line XV—XV in FIG. 14.
Figure 16:
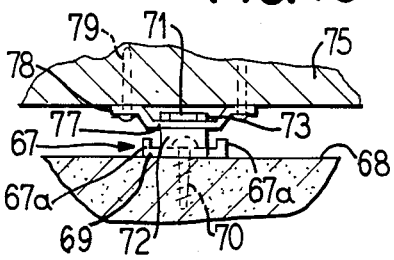
FIG. 16 is a sectional plan view taken substantially along the line XVI—XVI in FIG. 14.

Referring to FIGS. 14–16, an arrangement is depicted which is especially suitable for hanging wide frames, that is frames that are of such width that a central hanger would have to be too long or wide to provide the desired results. Accordingly, a plurality, in this instance a pair of bracket devices 67 is provided adapted to be mounted on a vertical supporting surface 68 in any horizontally spaced relation which will suit the purpose. For an especially heavy frame or other object to be hung, more than the pair of the bracket devices 67 may be employed if desired.

Each of the bracket devices 67 may comprise a sheet metal stamping which is vertically elongated, provided with angular reinforcing flanges **67*a* at the opposite sides, and having a vertically elongated flat base plate means in the of a bar body 69 with a vertically elongated fastener hole 69*a* for accommodating a plurality, herein two vertically spaced fasteners such as screws 70 for not only maintaining the bracket body 69** in the desired vertical orientation but also against turning out of proper vertical position.

At their upper ends, the 67 are equipped with prong and barb means substantially like the prong and barb means of the device 37. For this purpose, each of the bracket devices 67 has on its upper end edge a prong 71 offset from the body bar of the device by means of an integral offsetting flange 72. While the respective prongs 71 may be provided with upstanding spaced barbs 73, which are similar to and function similarly as the barbs 41 of the device 37, picture hanging shoulder clips 74 are desirably provided for attachment to an object such as a frame 75 and adapted for nested engagement with the prongs 71. Each of the clips 74 may comprise a stamped sheet metal strip having an intermediate offset socket portion 77 adapted to nest as a shoulder in the upwardly directed socket or cradle provided within the angle defined by the respective prongs 71 and the offsetting flanges 72. Oppositely extending coplanar attachment flanges 78 on the clips 74 are adapted to be secured to the frame 75 as by means of fasteners such as nails or screws 79.

Level hanging of the frame 75 is readily attainable even though the clips 74 may not be quite accurately horizontally disposed. Either or both of the brackets 67 may be vertically adjusted relatively by means of the vertical slots 69*a* and fasteners 70 to attain the accurate horizontal hung position of the frame.

If desired, of course, the brackets 67 are adapted to be employed, in substantially the manner depicted in FIG. 8 or FIG. 10, for supporting a frame directly by its top molding by engagement of a downwardly facing surface on the molding by means of the prongs 71.

From the foregoing it will be apparent that the present invention provides a new and improved picture frame hanging device of considerable versatility, adapted for supporting frames of various constructions. The device embodies a low cost structure and is simple and easy to install with substantial precision and is adapted to support the frames in a stable, non-skewing hanging position. Where there is no obstruction on the back of the frame, flush, flat abutment of the frame against a vertical supporting surface is facilitated. By the term "picture frames or like objects" is meant any picture frame, a mirror frame, a mirror or picture or similar article even if not equipped with a frame but having a hanging wire or bar or similar device at its back for hanging purposes, or the like.

It will be understood that variations and modifications may be effected without departing from the spirit and scope of the novel concepts of this invention.

I claim as my invention:

1. A hanging device for picture frames or like objects, comprising:

an elongate horizontally positionable one piece sheet metal stamping base bar of substantial width having front and back faces and means for attaching the bar to a vertical supporting surface such as a wall and with said back face directed toward said supporting surface;

and upwardly projecting means at opposite end portions of said bar;

said upwardly projecting means being adapted to engage a downwardly facing surface of the top molding of a frame, or other hanging means on a picture or other object to be hung, for thereby supporting the same in a stable, non-skewing hanging position;

said means for attaching the base bar comprising a horizontally elongate fastener hole in one end portion of the bar for a first fastener and a vertically elongate fastener hole in the opposite end portion of the bar for a second fastener, so that accurate horizontal adjustment can be attained by horizontally adjusting the bar along said first fastener, and then attaining accurate vertical adjustment by fulcruming the bar about said first fastener and along said second fastener, and adapted for finally fixedly securing the bar in adjusted position by means of said fasteners.

2. A device according to claim 1, wherein said upwardly projecting means comprises a respective prong bent from each of the end portions of said base bar.

3. A device according to claim 2, wherein said prongs have tips extending substantially above a top edge of said bar, so that the top moulding can rest directly against said supporting surface above said top edge.

4. A device according to claim 1, wherein said base bar has additional fastener receiving hole means intermediate said elongate holes.

5. A device according to claim 1, in combination with an extruded aluminum picture frame having a top moulding with a depending rib along a backside of said frame, and wherein said upwardly projecting means comprise prongs which have cam surfaces extending downwardly and toward said back face, and said rib engaging and tending to ride downwardly on said cam surfaces toward the supporting surface for thereby biasing said frame to rest flush against said supporting surface.

6. A method of hanging on a vertical surface a picture frame or like object having a downwardly facing upper portion, comprising:

providing a horizontally elongated base bracket member of substantial width and having means thereon for engagement by said upper portion of said object;

equipping said member with a vertically extending elongate first fastener hole in one end portion of said member and with a second horizontally elongated fastener hole in the opposite end portion of said member, attaching said member to the vertical supporting surface by driving fasteners through said holes;

and before tightening said fasteners adjusting the horizontal attitude of said member and thereby said means by vertically adjusting said one end portion along said fastener in said vertical first hole and about a fulcrum provided by the fastener extending through said second hole, and then securing the member fixedly in place by tightening said fasteners.

7. A method according to claim 6, which comprises providing said upwardly projecting means as relatively sharp tipped prongs and with the tips of the prongs extending a substantial distance above a top edge of said base bracket member, providing a picture frame having an extruded top moulding and a depending rib thereon, and engaging said rib on cam surfaces on said prongs sloping downwardly toward said top edge and camming said rib toward said supporting surface and thereby effecting engagement of at least said upper moulding against said supporting surface.

8. A hanging device for a picture frame or like object to be hung on a vertical supporting surface, comprising:

elongate flat base plate means of sheet-like material with an upper edge, and the plate means being of substantial flat plate width and having front and back faces;

horizontally spaced means for attaching the plate means with said back face against the supporting surface;

said plate means having a pair of prong structures which are arranged to be in horizontally spaced vertical alignment and projecting outwardly and upwardly relative to the front face of said base plate means when the base plate means is attached to the supporting surface by said attaching means;

and the prong structures being bent angularly from the base means and extending substantially above said upper plate of said plate means, so that downwardly facing support surface on the upper portion of a picture frame or like object is adapted to be engaged with said prong structures free and clear above said upper edge.

9. A device according to claim 8, wherein said plate means comprises a one-piece horizontal flat sheet metal bar having said pair of prong structures in the form of angularly outwardly bent wing-like elements at the opposite ends of the otherwise flat bar and with tips of the elements projecting upwardly above said upper edge.

10. A device according to claim 9, wherein said wing like elements are in vertical planes at the extremities of said ends of the bar.

11. A device according to claim 9, wherein said wing like elements extend outwardly and upwardly from upper edges of said end portions.

12. A device according to claim 9, in combination with an extruded aluminum picture frame having a top molding structure provided with a rearwardly opening horizontal channel defined along its opening by vertically extending ribs facing in spaced relation toward one another, and said wing-like elements received within said channel and engaged with said ribs.

13. A device according to claim 8, in combination with an extruded aluminum picture frame having a top molding provided with a downwardly facing surface, and said prong structure engaging said downwardly facing surface.

14. A device according to claim 8, in combination with hanger clip means mounted on the back of the picture frame or like object and engaged with said prong structure.

15. A device according to claim 14, wherein said clip means comprises a horizontal bar having offset hanger fingers at its opposite ends, and said prong structure provides upwardly opening sockets within which said fingers are engaged.

16. A device according to claim 8, wherein each of said prong structures has a plurality of horizontally spaced upwardly projecting barbs for penetrating said downwardly facing support surface, said prongs being separated by a horizontal upwardly facing shoulder edge surface.

17. A device according to claim 8, wherein said base plate means comprises a plurality of vertically extending members each of which has one of said prong structures on its upper end edge.

18. A device according to claim 17, wherein each of said members has an elongate vertical fastener slot, and a pair of vertically spaced fasteners securing each of the members through said slot to the supporting surface.

19. A hanging device for picture frames or like objects, comprising:

an elongated flat base bar plate means of substantial flat plate width and having a front face and a back face and an upper edge;

horizontally spaced means for attaching the base bar plate means with said back face against a vertical supporting surface;

a pair of horizontally spaced and aligned upwardly extending prongs projecting at right angles outwardly and upwardly relative to the front of said bae bar plate means;

each of the prongs extending substantially above the upper edge of said base bar plate means;

and each of the prongs having a pair of upwardly extending spaced barbs with an upwardly facing shoulder edge surface extending between each pair of barbs;

whereby a downwardly facing surface of the upper portion of a picture frame or like object is adapted to be engaged and penetrated by said barbs for stabilized hanging of the object on said supporting surface, with the upper portion of the object supported by the prongs above said upper edge of the bar means and the back of the object lying flat against said supporting surface.

20. A device according to claim 19, wherein said attaching means includes holes, one hole in one end portion of said base bar and such hole being elongate horizontally, and another fastener hole is located in the opposite end portion of the base bar and is elongated vertically.

21. A device according to claim 20, wherein said bar has a plurality of additional holes between said elongate holes.

22. A device according to claim 19, in combination with an extruded aluminum picture frame having a top moulding with a depending rib along a back face of the frame, and wherein said prongs include downwardly and rearwardly extending cam surfaces facing generally toward the supporting surface, and said rib engaging and tending to slide downwardly on said cam surfaces toward said supporting surface and thereby biasing said frame to rest flush against said supporting surface.

23. A method of hanging a picture frame or like object, comprising:

providing an elongated flat base bar plate means of substantial flat plate width and having a front face and a back face and an upper edge;

attaching said base bar plate means at horizontally spaced points with said back face against a vertical supporting surface;

locating a pair of horizontally spaced and aligned upwardly extending prongs to project at right angles outwardly and upwardly relative to the front of said base bar plate means;

effecting upward extension of said prongs substantially above the upper edge of said base bar plate means;

and effecting upward extension on each of the prongs a pair of spaced barbs with an upwardly facing shoulder edge surface extending between each pair of barbs, so that a downwardly facing surface of the upper portion of said picture frame or like object can be engaged and penetrated by said barbs for stabilized hanging of the object on said supporting surface, with the upper portion of the object supported by the prongs above said upper edge of the bar means and the back of the object lying flat against said supporting surface.

* * * * *

UNITED STATES PATENT AND TRADEMARK OFFICE

CERTIFICATE OF CORRECTION

PATENT NO. : 4,804,161

DATED : February 14, 1989

INVENTOR(S) : William H. Wallo

It is certified that error appears in the above-indentified patent and that said Letters Patent is hereby corrected as shown below:

Column 9, line 12, change "upper plate" to read --upper edge--.

Signed and Sealed this

Fifteenth Day of April, 1997

Bruce Lehman

*Attest:*

BRUCE LEHMAN

*Attesting Officer*

*Commissioner of Patents and Trademarks*